US005337916A

United States Patent [19]

Voss

[11] Patent Number: 5,337,916

[45] Date of Patent: Aug. 16, 1994

[54] DADOED AND V-GROOVED BOX

[75] Inventor: Harry A. Voss, Canandaigua, N.Y.

[73] Assignee: Rock City Box Company, Utica, N.Y.

[21] Appl. No.: 130,782

[22] Filed: Oct. 4, 1993

[51] Int. Cl.[5] ..... B65D 5/20; B65D 5/56

[52] U.S. Cl. ..... 220/418; 229/182; 229/931; 493/59; 493/69; 493/79; 493/907

[58] Field of Search ..... 493/59–62, 493/69, 79, 906–908; 229/165, 182, 930, 931; 220/416, 418, 441

[56] References Cited

U.S. PATENT DOCUMENTS

| | | | |
|---|---|---|---|
| 549,064 | 10/1895 | Gay | 229/931 |
| 2,026,698 | 1/1936 | Nelson | 229/931 |
| 2,056,094 | 9/1936 | Claff | 229/165 |
| 2,139,845 | 12/1938 | Neely . | |
| 2,634,046 | 4/1953 | Weber . | |
| 2,932,439 | 4/1960 | Sparling . | |
| 2,985,075 | 5/1961 | Knutsson-Hall | 229/931 |
| 3,039,372 | 6/1962 | Bombard . | |
| 3,649,398 | 3/1972 | Keith . | |
| 3,654,053 | 4/1972 | Toedter . | |
| 3,913,822 | 10/1975 | Heaps, Jr. . | |
| 3,980,005 | 9/1976 | Buonaiuto | 493/79 |
| 4,244,508 | 1/1981 | Schulman | 229/182 |
| 4,373,929 | 2/1983 | Smith . | |
| 4,623,072 | 11/1986 | Lorenz | 493/906 |
| 4,883,555 | 11/1989 | Turngen | 493/907 |
| 4,905,864 | 3/1990 | Balin . | |

FOREIGN PATENT DOCUMENTS

| | | | |
|---|---|---|---|
| 267694 | 8/1964 | Netherlands | 229/165 |

*Primary Examiner*—Gary E. Elkins
*Attorney, Agent, or Firm*—Harris Beach & Wilcox

[57] ABSTRACT

A box is formed of a blank of sheet material wherein a filler is sandwiched between an inner liner and an outer liner. A dado groove is formed parallel to each edge and a V-groove is formed parallel to the dado groove on the side away from the edge. The blank is folded up at the V-groove and then is folded back at the dado to produce a 180 degree fold. The outer liner extends continuously over the outside, top edge, and inner side of the resulting double thickness wall.

6 Claims, 2 Drawing Sheets

DADOED AND V-GROOVED BOX

BACKGROUND OF THE INVENTION

This invention relates to boxes and cartons for shipping, storage, or display, and is more particularly concerned with boxes formed of corrugated paper board or equivalent sheet material where a filler is sandwiched between an inner liner and an outer liner. The invention relates not only to boxes and drawings made of corrugated paper starting material, but also to boxes of other flat sheet material where a filler is sandwiched between outer and inner liners. An alternative filler can be, e.g., cellulose fiber or a foamed polymer. The liners can be paper, or in some cases, a plastic film or metallized plastic film. The sheet material can also be wrapped chipboard.

Shallow boxes are often employed for carrying small items of merchandise, such as cosmetics, handkerchiefs, or packages of photographic film. The box is required to be lightweight, but substantially rigid, and must have a neat and trim appearance. A layer of paper serves as the wrapper or liner, and can be plain or printed paper. The liner should continue over the side wall of the box covering all sides and edges so that the filler is entirely concealed. Any text, labels, or decoration printed on the liner should not be cut through. High stacking strength is desirable.

A typical cardboard box structure of this type is shown in U.S. Pat. No. 2,634,046, which provides a double thickness side wall for added rigidity. In this case the bank is dadoed to form two channels parallel to the edge defining the folds where the side wall is formed. This results in rounded edges on the lower and upper parts of the side walls.

Other boxes where the folds occur at dadoed grooves are shown, e.g., in U.S. Pat. No. 2,932,439, and U.S. Pat. No. 2,139,845. Boxes where V-grooves are used at fold lines are described, e.g., in U.S. Pat. No. 3,654,053 and U.S. Pat. No. 3,913,822.

No one has previously employed V-grooving and dadoing in combination to form a box of high strength and great crush resistance both vertically and laterally.

The industry has been seeking a box construction which provides excellent cushioning to the product that it carries, and which avoids or eliminates most of the flexing that is associated with previous boxes or trays of this type.

OBJECTS AND SUMMARY OF THE INVENTION

Accordingly, it is an object of this invention to provide a box of high strength and attractive appearance, and which avoids the drawbacks of the prior art.

It is another object to provide a box of high strength and crush resistance, with excellent cushioning.

It is yet another object to provide a box or tray that avoids undesirable flexing, and can be employed as a set-up box.

In accordance with an aspect of this invention a box is constructed from a blank of sheet material in which a filler is sandwiched between outer and inner liners. The blank is dadoed to form dadoed grooves parallel to the side edges. Here a strip of the inner liner is removed as is the filler beneath it leaving the outer liner. Then the blank is V-grooved parallel to the dado grooves on the sides away from the edges. The edges and the dado grooves define inner side wall portions, and the dado grooves and V-grooves define outer side wall portions. The blank is die cut at the corners.

To form the side walls, the blank is folded 90 degrees at the V-groove so that the outer wall portions extend upwards, and then the inner wall portion is folded 180 degrees inward so that the inner liner on the outer wall portion is adjacent the inner liner on the inner wall portion.

A hot melt glue or other bonding agent can be applied in conventional fashion to the V-groove, and to the interface between the outer and inner wall portions.

Because the outer liner is continuous over the entire side wall, no overwrap is required.

The V-groove and dado combination give the box an increased stacking strength, because of the strong 90 degree fold at the V-groove and because of the foldover in the dadoed zone.

The box can be constructed of double-wall corrugated paper with burst strength e.g., of 275, 350, or 500 pounds per square inch. The box can be utilized as a tray, with an inverted top made of the same materials as the base.

The box of this invention is extremely strong and resists both vertical and side crushing, gives excellent cushioning to the merchandise or product, and eliminates most of the flexing associated with the set-up boxes that it replaces.

The dadoed foldover eliminates open exposed fluting, so the box does not require the overwrapping that is associated with conventional V-grooved corrugated boxes. This reduces both material costs and manufacturing costs.

Also, the dadoed foldover not only permits the 180 degree fold-back that gives increase stacking strength, but also maintains the integrity of the pre-printed outer liner.

The above and many other objects, features and advantages of this invention will become apparent from the ensuing description of a preferred embodiment, to be read in connection with the accompanying Drawing.

Figure 1:
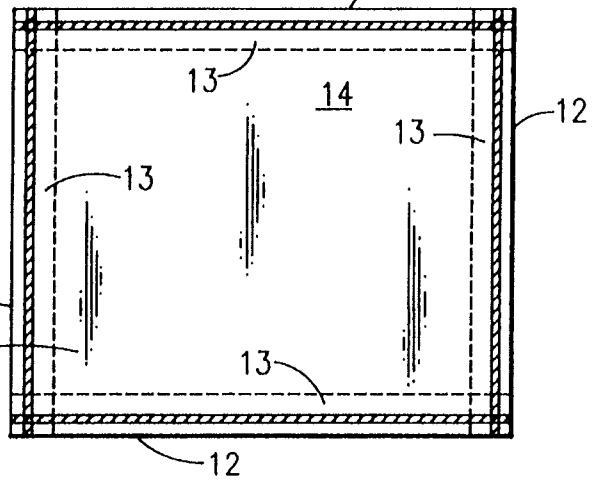
FIG. 1 is a plan view of a box blank of this invention showing locations of dado grooves and V-grooves.
Figure 2:
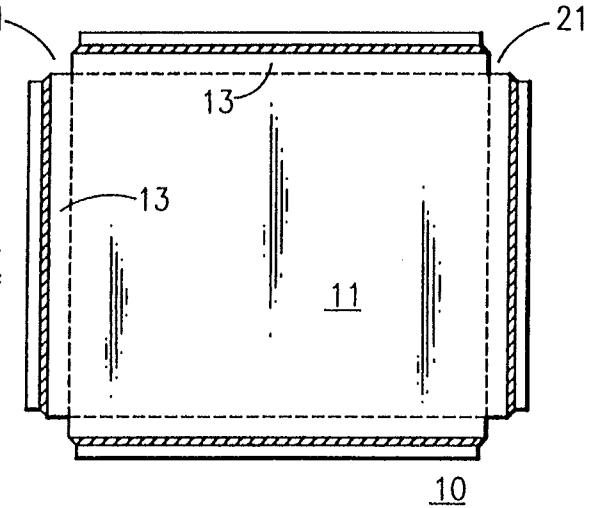
FIG. 2 is a plan view of the blank, with die-cut corners.

DETAILED DESCRIPTION OF THE PREFERRED EMBODIMENT with reference to the Drawing, and initially to FIGS. 1 and 2, a shallow box according to this invention and a method of constructing it involve a rectangular blank 10 of sheet material about one-quarter inch in thickness. The blank 10 has a central base or floor panel 11 and four side edges 12, at each of which there is a respective side wall portion 13.

Figure 4:
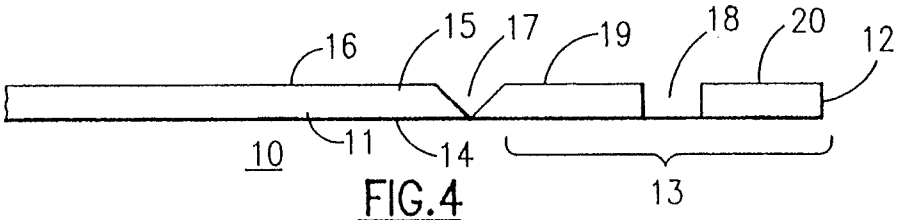
FIG. 4 is a schematic elevation showing the V-groove and dado groove in the box blank of this embodiment.

As shown in more detail in the cross-sectional elevation of FIG. 4, the blank material has a lower or outer liner 14 which is a sheet of paper optionally having a suitable coating, a filler 15 of corrugated paper or other suitable material, and a top or inner liner 16 of paper. The filler 15 is sandwiched between the liners 14,16.

V-grooves 17 are cut in the blank at the positions shown by dash lines in FIGS. 1 and 2. In this step the inner liner is removed and a V-shaped strip of the filler material are removed, leaving the outer liner 14. The V-grooves 17 extend parallel to the respective edges 12 and define the perimeter of the base panel 11.

Then dado grooves 18 are cut parallel to the edges 12 and the V-grooves 17 and about midway between them. As shown in FIG. 4, in the zones of the dado grooves in the inner liner and a rectangular strip of the filler are removed. The outer liner 14 remains and extends continuously from edge 12 to edge 12. The dado grooves 18 are cut to a width substantially two times the thickness of the blank. In each side wall portion 13, the respective V-groove 17 and dado groove 18 define an outer wall portion 19 and the edge 12 and dado groove 18 define an inner wall portion 20.

Figure 3:
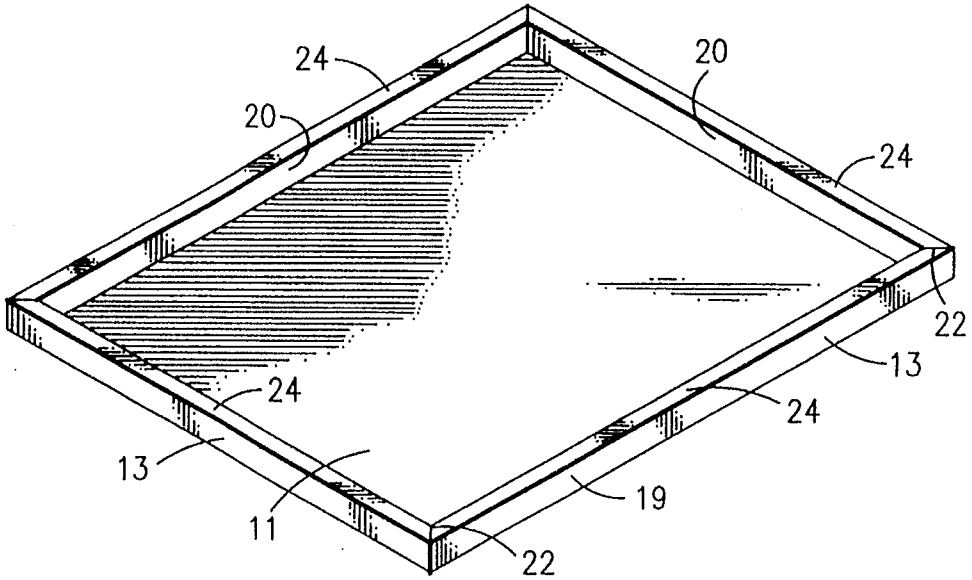
FIG. 3 is a perspective view of a box according to an embodiment of this invention.

As shown in FIG. 2, die-cut corner cutouts 21 are formed at each corner of the blank 20, so that the outer wall portions 13 fold together to meet at mitered corners 22 in the finished box or tray 23, as shown in FIG. 3.

The sequence in bending the blank 10 is shown in FIGS. 4, 5, 6, and 7.

A bonding agent, such as a hot melt glue, can be applied at the V-groove 17 and can also be applied at the dado 18 and to the liner 16 at one or both of the inner and outer wall portions 19,20.

Figure 5:
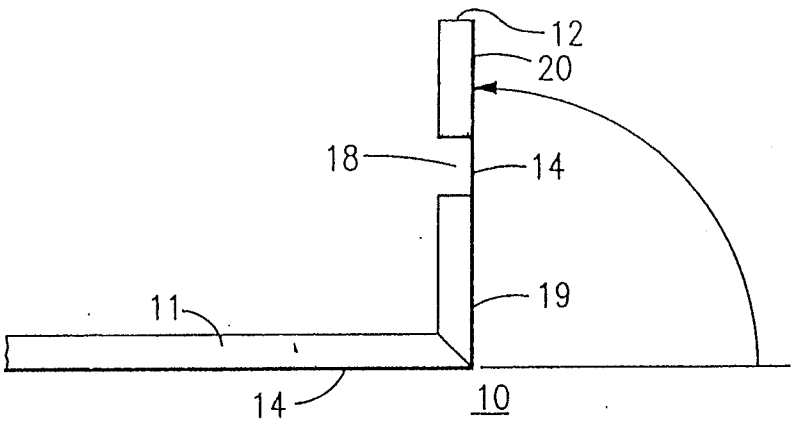
FIGS. 5, 6, and 7 show steps of folding at the v groove and dado in forming a side wall in the box of this embodiment.
Figure 7:
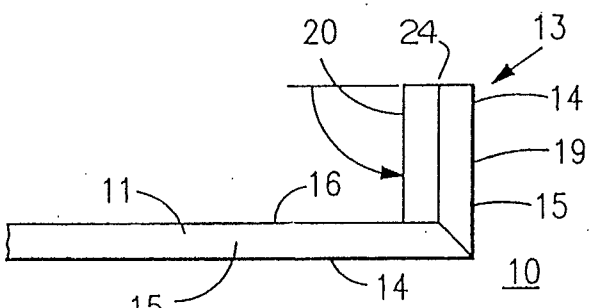
Figure 6:
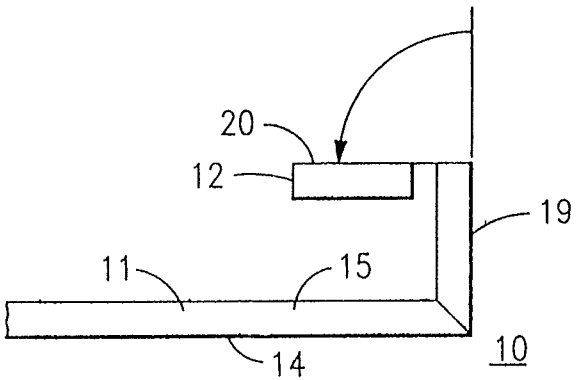

The blank 10 is bent ninety degrees at the V-groove 17 so that the outer wall portion 19 projects upwards, as shown in FIG. 5. Then the inner wall portion 20 is bent over as shown in FIG. 6 so that the outer liner 14 extends across the filler at the dado groove 18. Thereafter, the inner wall portion is folded down as shown in FIG. 7 to contact the inner liner of the inner wall portion 20 with the inner liner of the outer wall portion 19. As illustrated in FIG. 7, the outer line 14 is continuous from the base panel 11 up the outer wall portion 19, across a top edge 24 of the side wall, and down the inner wall portion 20 to meet the inner liner 16. All of the filler 15 is concealed at this stage, and no additional wrap is required.

The wall portions 13 are of double thickness and have excellent stiffness. The V-groove construction, in combination with the top edge 24 formed at the dado groove 17 makes the side walls 13 extremely strong. The flat 180-degree foldback of the outer liner 14 at the top wall edge 24 increases stacking strength without sacrificing integrity of the liner 14. The liner 14 can be preprinted all the way to the edge 12.

In some alternative embodiments the V-grooved and dadoed construction can be used at a single edge of the blank or at selected side edges to form side walls, depending on the application.

While the invention has been described with reference to a preferred embodiment, it should be appreciated that the invention is not limited to that precise embodiment. Rather, many modifications and variations will present themselves to persons skilled in the art without departing from the scope and spirit of this invention, as defined in the appended claims.

I claim:

1. Method of forming a box from a blank of sheet material having an outer liner, an inner liner, and a filler sandwiched between said liners, said blank having at least one straight edge and said sheet material having a predetermined thickness; the method comprising the steps of forming a dado groove parallel to said edge by removing a strip of said inner liner and said filler, leaving said outer liner, said dado groove having a width substantially twice the thickness of said sheet material;

forming a V-groove parallel to said dado groove on a side away from said edge by removing a strip of said inner liner and a portion of said filler, leaving said outer liner to extend continuously to said edge;

said edge and said dado groove defining an inner wall portion therebetween and said dado groove and said V-groove defining an outer wall portion therebetween;

folding said blank at said V-groove so that said outer wall portion extends upwards therefrom; and folding said blank at said dado groove to form a substantially 180 degree fold with said inner liner on said outer wall portion positioned against the inner lining on said inner wall portion so that the inner and outer wall portions create a double thickness wall, and with said outer liner extending continuously over an outer side, a top edge and an inner side of said double thickness wall.

2. The method of claim 1 further comprising the step of applying a bonding agent onto said V-groove and onto the inner liner on said inner and outer wall portions.

3. The method of claim 1 wherein said blank has a second edge that meets said first mentioned edge at a corner, and further comprising forming a dado groove and a V-groove in said blank parallel to said second edge; and die cutting the blank at said corner so that double thickness walls can be formed at said one and said second edges.

4. The method of claim 3 wherein said die cutting produces said corner as a mitered corner.

5. A shipping or storage container formed of a sheet material of a predetermined thickness and in which a filler is sandwiched between an inner liner and an outer liner; comprising a base panel extending between a plurality of double thickness side walls, each side wall being formed of an inner wall portion and an outer wall portion, with a dado cut in said sheet material extending parallel to a respective edge defining said inner wall portion therebetween and a V-groove in said sheet material extending parallel to said dado groove defining said outer wall portion therebetween, with said outer liner extending continuously from said base panel to said edge, said outer wall portion being folded upwards at said V-groove, and said inner wall portion being folded substantially 180 degrees at said dado groove, so that said outer liner extends continuously over an outer side, a top edge, and an inner side of each said double thickness wall.

6. The shipping or storage container of claim 5 wherein corners of said sheet material are die cut so that said double thickness walls meet at mitered corners.

* * * * *